US011276933B2

(12) United States Patent
Rogers

(10) Patent No.: US 11,276,933 B2
(45) Date of Patent: Mar. 15, 2022

(54) HIGH-GAIN ANTENNA WITH CAVITY BETWEEN FEED LINE AND GROUND PLANE

(71) Applicant: THE BOEING COMPANY, Chicago, IL (US)

(72) Inventor: John E. Rogers, Owens Cross Roads, AL (US)

(73) Assignee: THE BOEING COMPANY, Chicago, IL (US)

( * ) Notice: Subject to any disclaimer, the term of this patent is extended or adjusted under 35 U.S.C. 154(b) by 184 days.

(21) Appl. No.: 16/675,357

(22) Filed: Nov. 6, 2019

(65) Prior Publication Data

US 2021/0135368 A1 May 6, 2021

(51) Int. Cl.

| | |
|---|---|
| ***H01Q 9/04*** | (2006.01) |
| ***H01Q 1/28*** | (2006.01) |
| ***H01Q 1/12*** | (2006.01) |

(52) U.S. Cl.

CPC ..... *H01Q 9/0457* (2013.01); *H01Q 1/125* (2013.01); *H01Q 1/28* (2013.01)

(58) Field of Classification Search

CPC ..... H01Q 9/0457; H01Q 1/28; H01Q 1/125; H01Q 1/238; H01Q 21/065; H01Q 13/18; H01Q 9/0407; H01Q 1/38; H01Q 13/10; H01Q 21/0075

See application file for complete search history.

(56) References Cited

U.S. PATENT DOCUMENTS

| | | | | |
|---|---|---|---|---|
| 3,665,480 A | | 5/1972 | Fassett | |
| 4,197,545 A | | 4/1980 | Favaloro et al. | |
| 4,835,538 A | | 5/1989 | McKenna et al. | |
| 4,862,185 A | | 8/1989 | Andrews et al. | |
| 5,005,019 A | | 4/1991 | Zaghloul et al. | |
| 5,043,738 A | | 8/1991 | Shapiro et al. | |
| 5,287,116 A | * | 2/1994 | Iwasaki | H01Q 9/0442 343/700 MS |
| 5,353,035 A | | 10/1994 | Cuervo-Arango et al. | |
| 5,448,250 A | * | 9/1995 | Day | H01Q 1/1271 343/700 MS |
| 5,581,267 A | | 12/1996 | Matsui et al. | |

(Continued)

FOREIGN PATENT DOCUMENTS

| | | |
|---|---|---|
| CN | 105846051 A | 8/2016 |
| JP | 2003283239 A | 10/2003 |
| KR | 100449846 B1 | 9/2004 |

OTHER PUBLICATIONS

Cheng, Yu Jian, et al., "W-Band Large-Scale High-Gain Planar Integrated Antenna Array," IEEE Transactions on Antennas and Propagation, vol. 62, No. 6, Jun. 2014, pp. 3370-3373.

(Continued)

*Primary Examiner* — David E Lotter

(74) *Attorney, Agent, or Firm* — Moore IP Law

(57) ABSTRACT

An antenna device includes a conductive patch antenna element and a conductive feed line. The conductive feed line and the conductive patch antenna element are separated by one or more first dielectric layers. The antenna device also includes a ground plane. The ground plane is separated from the conductive feed line by a spacer structure that defines one or more walls of a cavity between the conductive feed line and the ground plane. The spacer structure includes one or more second dielectric layers.

21 Claims, 9 Drawing Sheets

(56) References Cited

U.S. PATENT DOCUMENTS

| | | | | |
|---|---|---|---|---|
| 5,914,693 | A | 6/1999 | Takei et al. | |
| 5,977,710 | A | 11/1999 | Kuramoto et al. | |
| 6,003,808 | A | 12/1999 | Nguyen et al. | |
| 6,133,882 | A | 10/2000 | LaFleur et al. | |
| 6,150,982 | A | 11/2000 | Bergstedt et al. | |
| 6,191,740 | B1 | 2/2001 | Kates et al. | |
| 6,252,549 | B1 | 6/2001 | Derneryd | |
| 6,320,543 | B1 | 11/2001 | Ohata et al. | |
| 6,593,887 | B2 | 7/2003 | Luk et al. | |
| 6,646,609 | B2 | 11/2003 | Yuasa et al. | |
| 7,057,564 | B2 | 6/2006 | Tsai et al. | |
| 7,471,248 | B2 | 12/2008 | Popugaev et al. | |
| 8,384,499 | B2 | 2/2013 | Suzuki et al. | |
| 8,665,142 | B2 | 3/2014 | Shijo et al. | |
| 8,797,222 | B2 | 8/2014 | Chamseddine | |
| 8,952,521 | B2 | 2/2015 | Wojnowski et al. | |
| 9,002,571 | B1 | 4/2015 | Gribble et al. | |
| 9,325,058 | B2 * | 4/2016 | Le | H01Q 1/287 |
| 9,496,613 | B2 | 11/2016 | Sawa | |
| 2002/0047803 | A1 | 4/2002 | Ishitobi et al. | |
| 2003/0103006 | A1 | 6/2003 | Yamada | |
| 2004/0090369 | A1 | 5/2004 | McCarrick | |
| 2004/0104852 | A1 | 6/2004 | Choi et al. | |
| 2004/0196203 | A1 | 10/2004 | Lier et al. | |
| 2004/0239565 | A1 | 12/2004 | Brachat | |
| 2004/0252058 | A1 | 12/2004 | Rawnick et al. | |
| 2005/0057415 | A1 | 3/2005 | Rawnick et al. | |
| 2005/0195110 | A1 | 9/2005 | Lin et al. | |
| 2006/0001574 | A1 | 1/2006 | Petros | |
| 2006/0044188 | A1 | 3/2006 | Tsai et al. | |
| 2007/0126641 | A1 | 6/2007 | Saily | |
| 2007/0279143 | A1 | 12/2007 | Itsuji | |
| 2008/0136553 | A1 | 6/2008 | Choi et al. | |
| 2008/0252544 | A1 | 10/2008 | Irion et al. | |
| 2009/0046017 | A1 | 2/2009 | Foo | |
| 2009/0046029 | A1 | 2/2009 | Nagai | |
| 2009/0058731 | A1 | 3/2009 | Geary et al. | |
| 2009/0289858 | A1 | 11/2009 | Olsson | |
| 2010/0001916 | A1 | 1/2010 | Yamaguchi et al. | |
| 2010/0073238 | A1 | 3/2010 | Jun et al. | |
| 2010/0177011 | A1 * | 7/2010 | Sego | H01Q 1/28 343/893 |
| 2010/0177012 | A1 | 7/2010 | Morrow | |
| 2010/0181379 | A1 | 7/2010 | Okegawa et al. | |
| 2010/0245155 | A1 | 9/2010 | Miyazato et al. | |
| 2011/0025574 | A1 | 2/2011 | Tiezzi et al. | |
| 2011/0062234 | A1 | 3/2011 | Oishi | |
| 2011/0090129 | A1 | 4/2011 | Weily et al. | |
| 2011/0165839 | A1 | 7/2011 | Kawamura et al. | |
| 2012/0276856 | A1 | 11/2012 | Joshi et al. | |
| 2012/0287019 | A1 | 11/2012 | Sudo et al. | |
| 2012/0299783 | A1 | 11/2012 | Lee et al. | |
| 2013/0063310 | A1 | 3/2013 | Mak et al. | |
| 2013/0278467 | A1 | 10/2013 | Dassano et al. | |
| 2014/0110841 | A1 | 4/2014 | Beer et al. | |
| 2014/0151860 | A1 | 6/2014 | Nakamura et al. | |
| 2014/0152509 | A1 | 6/2014 | Liu et al. | |
| 2014/0168014 | A1 | 6/2014 | Chih et al. | |
| 2014/0354411 | A1 | 12/2014 | Pudenz | |
| 2015/0194730 | A1 | 7/2015 | Sudo et al. | |
| 2015/0236425 | A1 | 8/2015 | Sudo et al. | |
| 2015/0249283 | A1 | 9/2015 | Watanabe et al. | |
| 2015/0349421 | A1 | 12/2015 | Sharawi | |
| 2015/0364823 | A1 | 12/2015 | Hashimoto et al. | |
| 2015/0380789 | A1 | 12/2015 | Jakoby et al. | |
| 2016/0036130 | A1 | 2/2016 | Hsu et al. | |
| 2016/0056544 | A1 | 2/2016 | Garcia et al. | |
| 2016/0126617 | A1 | 5/2016 | Jan et al. | |
| 2016/0190696 | A1 | 6/2016 | Preradovic et al. | |
| 2016/0190697 | A1 | 6/2016 | Preradovic et al. | |
| 2016/0218420 | A1 | 7/2016 | Leung et al. | |
| 2016/0261036 | A1 | 9/2016 | Sato et al. | |
| 2016/0294045 | A1 | 10/2016 | Shiu et al. | |
| 2016/0295335 | A1 | 10/2016 | Vajha et al. | |
| 2016/0301129 | A1 | 10/2016 | Ying et al. | |
| 2016/0322714 | A1 | 11/2016 | Ying et al. | |
| 2016/0344093 | A1 | 11/2016 | Tagi et al. | |
| 2017/0054217 | A1 * | 2/2017 | Hashimoto | H01Q 13/10 |
| 2019/0115645 | A1 * | 4/2019 | Chang | H01Q 1/523 |
| 2019/0190110 | A1 * | 6/2019 | Clark | H01P 5/028 |
| 2019/0237844 | A1 | 8/2019 | Rogers et al. | |
| 2019/0237876 | A1 | 8/2019 | Rogers et al. | |
| 2019/0348749 | A1 * | 11/2019 | Thai | H01Q 1/38 |
| 2020/0067193 | A1 * | 2/2020 | Zhinong | H01Q 5/50 |
| 2020/0106192 | A1 * | 4/2020 | Avser | H01Q 1/38 |

OTHER PUBLICATIONS

Cook, Benjamin S et al., "Multilayer Inkjet Printing of Millimeter-Wave Proximity-Fed Patch Arrays on Flexible Substrates," IEEE Antennas and Wireless Propagation Letters, vol. 12, 2013, pp. 1351-1354.

Gauthier, Gildas P. et al., "A 94-GHz Aperture-Coupled Micromachined Microstrip Antenna," IEEE Transactions on Antennas and Propagation, vol. 47, No. 12, Dec. 1999, pp. 1761-1766.

Iwasaki, Hisao, "A Circularly Polarized Small-Size Microstrip Antenna with a Cross Slot," IEEE Transactions on Antennas and Propagation, vol. 44, No. 10, Oct. 10, 1996, pp. 1399-1401.

Papapolymerou, Ioannis et al., "Micromachined Patch Antennas," IEEE Transactions on Antennas and Propagation, vol. 46, No. 2, Feb. 1998, pp. 275-283.

Pozar, D. M., "Microstrip antenna aperture-coupled to a microstrip line," Electronics Letters, Jan. 1985, vol. 2, No. 2, pp. 49-50.

Pozar, D. M., et al., "Increasing the bandwidth of a microstrip antenna by proximity coupling," Electronic Letters, vol. 23, No. 8, Apr. 9, 1987, pp. 368-369.

Rida, Amin et al., "Proximity Coupled Fed Antenna Arrays on LCP with mm-Wave Applications," IEEE 2010, 4 pgs.

Sorkherizi, Milad S. et al., "Planar High-efficiency Antenna Array Using New Printed Ridge Gap Waveguide Technology," IEEE Transactions on Antennas and Propogation, vol. 65, No. 7, Jul. 2017, pp. 3772-3776.

Abu Tarboush, H. F. et al., "Bandwidth Enhancement for Microstrip Patch Antenna Using Stacked Patch and Slot", 2009 IEEE International Workshop on Antenna Technology, Mar. 2-4, 2009, 4 pgs.

Ambresh P. A., et al., "Effect of Slots on Microstrip Patch Antenna Characteristics", International Conference on Computer, Communication and Electrical Technology—ICCCET2011, Mar. 18 & 19, 2011, pp. 239-241.

Davidowitz, Marat et al., "Rigorous Analysis of a Circular Patch Antenna Excited by a Microstrip Transmission Line", IEEE Transactions on Antennas and Propagation, vol. 37, No. 8, Aug. 1989, pp. 949-958.

Pozar, David M. et al., "A Rigorous Analysis of a Microstripline Fed Patch Antenna", IEEE Transactions on Antennas and Propagation, vol. AP-35, No. 12, Dec. 1987, pp. 1343-1350.

* cited by examiner

HIGH-GAIN ANTENNA WITH CAVITY BETWEEN FEED LINE AND GROUND PLANE

FIELD OF THE DISCLOSURE

The present disclosure is generally related to an antenna with a cavity between a feed line of the antenna and a ground plane of the antenna.

BACKGROUND

Microstrip antennas are sometimes used in applications that demand small and/or light weight antennas. For example, the aerospace industry and the mobile device industry often use microstrip antennas to comply with size or weight constraints. One drawback of some microstrip antennas is that they can have limited gain and bandwidth. The gain of a microstrip antenna is further limited by the conductor and dielectric attenuation losses through the feed network.

SUMMARY

In a particular implementation, an antenna device includes a conductive patch antenna element and a conductive feed line. The conductive feed line and the conductive patch antenna element are separated by one or more first dielectric layers. The antenna device also includes a ground plane. The ground plane is separated from the conductive feed line by a spacer structure that defines one or more walls of a cavity between the conductive feed line and the ground plane. The spacer structure includes one or more second dielectric layers.

In another particular implementation, a method of forming an antenna device includes forming a conductive patch antenna element on a first dielectric layer. The method also includes forming a conductive feed line on the first dielectric layer or on a second dielectric layer. The method further includes forming one or more walls defining a cavity in a third dielectric layer. The method also includes forming a stack such that a first spacer structure separates the conductive patch antenna element and the conductive feed line and a second spacer structure separates the conductive feed line and the ground plane. The first spacer structure includes the first dielectric layer, the second dielectric layer, or both. The second spacer structure includes the third dielectric layer.

In another particular implementation, a system includes a structure defining a surface and communication equipment at least partially within the structure. The system also includes an antenna device physically mounted to the structure and electrically connected to the communication equipment. The antenna device includes a conductive patch antenna element disposed on a surface of a circuit board. The antenna device also includes a conductive feed line embedded within the circuit board, a ground plane, and a spacer structure separating the conductive feed line and the ground plane. The spacer structure defines one or more walls of a cavity between the conductive feed line and the ground plane. The spacer structure includes one or more dielectric layers.

The features, functions, and advantages described herein can be achieved independently in various implementations or may be combined in yet other implementations, further details of which can be found with reference to the following description and drawings.

DETAILED DESCRIPTION

Figure 1:
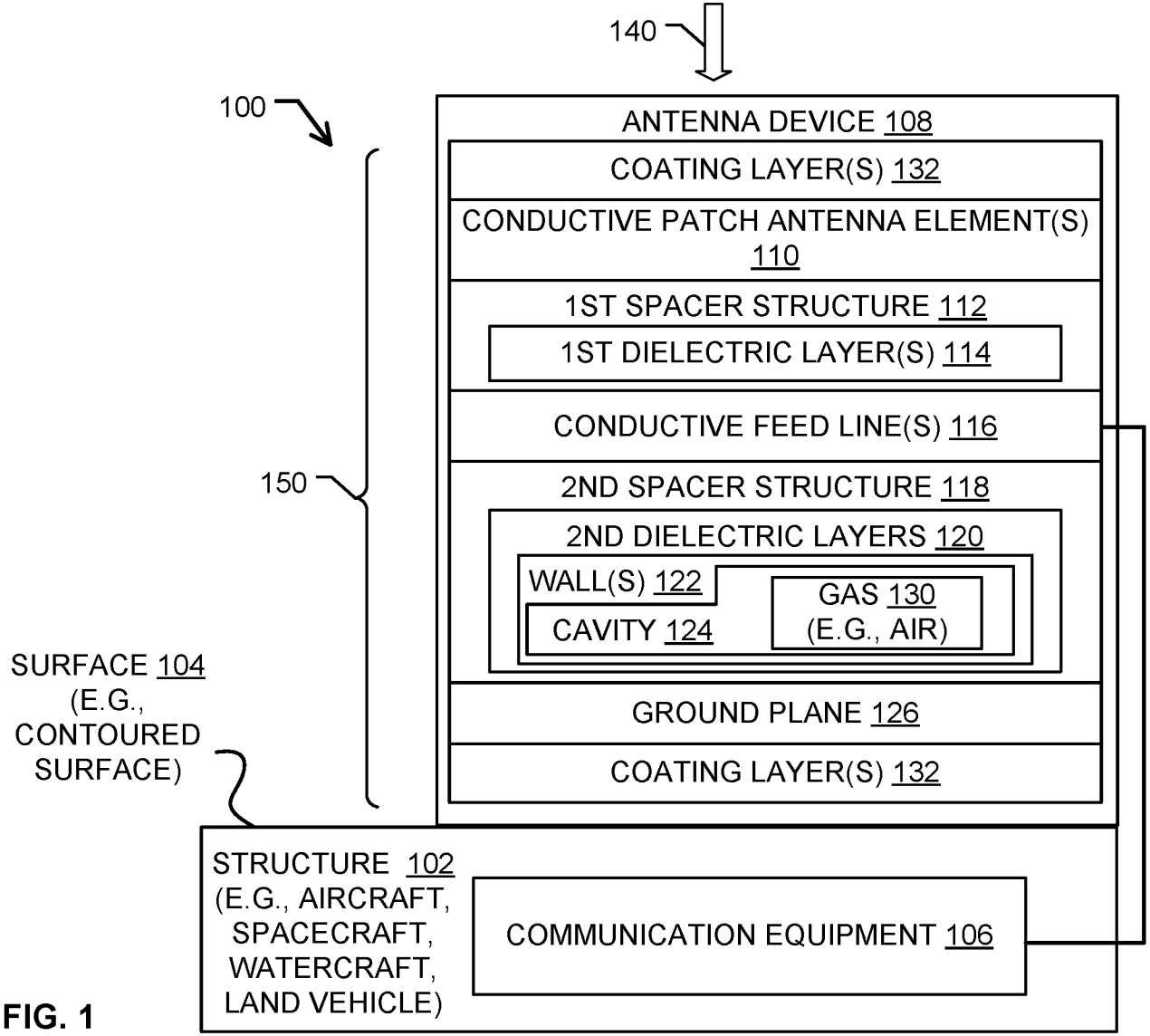
FIG. 1 is a block diagram that illustrates a system including a structure and an antenna device connected to the structure.

The figures and the following description illustrate specific exemplary embodiments of an antenna device (e.g., a microstrip antenna or microstrip antenna array) that includes a gas filled cavity between a feed line and a ground plane. The feed line and ground plane are spaced apart from one another by a dielectric layer, but the dielectric layer is absent from at least a portion of the area (e.g., the cavity) directly between the feed line and the ground plane. Presence of the cavity (rather than a portion of the dielectric layer) in the area directly between the feed line and the ground plane improves the gain of the antenna device by decreasing dielectric losses associated with the feed line. It will be appreciated that those skilled in the art will be able to devise various arrangements that, although not explicitly described or shown herein, embody the principles described herein and are included within the scope of the claims that follow this description. Furthermore, any examples described herein are intended to aid in understanding the principles of the disclosure and are to be construed as being without limitation. As a result, this disclosure is not limited to the specific embodiments or examples described below, but by the claims and their equivalents.

Particular implementations are described herein with reference to the drawings. In the description, common features are designated by common reference numbers throughout the drawings. In some drawings, multiple instances of a particular type of feature are used. Although these features are physically and/or logically distinct, the same reference number is used for each, and the different instances are distinguished by addition of a letter to the reference number. When the features as a group or a type are referred to herein (e.g., when no particular one of the features is being referenced), the reference number is used without a distinguishing letter. However, when one particular feature of multiple features of the same type is referred to herein, the reference number is used with the distinguishing letter. For example, referring to FIG. 2A, multiple conductive patch antenna elements are illustrated and associated with reference numbers 110A and 110B. When referring to a particular one of these conductive patch antenna elements, such as the conductive patch antenna element 110A, the distinguishing letter "A" is used. However, when referring to any arbitrary one of these conductive patch antenna elements or to these conductive patch antenna elements as a group, the reference number 110 is used without a distinguishing letter.

As used herein, various terminology is used for the purpose of describing particular implementations only and is not intended to be limiting. For example, the singular forms "a," "an," and "the" are intended to include the plural forms as well, unless the context clearly indicates otherwise. Further, some features described herein are singular in some implementations and plural in other implementations. For ease of reference herein, such features are generally introduced as "one or more" features and are subsequently referred to in the singular unless aspects related to multiple of the features are being described.

The terms "comprise," "comprises," and "comprising" are used interchangeably with "include," "includes," or "including." Additionally, the term "wherein" is used interchangeably with the term "where." As used herein, "exemplary" indicates an example, an implementation, and/or an aspect, and should not be construed as limiting or as indicating a preference or a preferred implementation. As used herein, an ordinal term (e.g., "first," "second," "third," etc.) used to modify an element, such as a structure, a component, an operation, etc., does not by itself indicate any priority or order of the element with respect to another element, but rather merely distinguishes the element from another element having a same name (but for use of the ordinal term). As used herein, the term "set" refers to a grouping of one or more elements, and the term "plurality" refers to multiple elements.

As used herein, "generating", "calculating", "using", "selecting", "accessing", and "determining" are interchangeable unless context indicates otherwise. For example, "generating", "calculating", or "determining" a parameter (or a signal) can refer to actively generating, calculating, or determining the parameter (or the signal) or can refer to using, selecting, or accessing the parameter (or signal) that is already generated, such as by another component or device. As used herein, "coupled" can include "communicatively coupled," "electrically coupled," or "physically coupled," and can also (or alternatively) include any combinations thereof. Two devices (or components) can be coupled (e.g., communicatively coupled, electrically coupled, or physically coupled) directly or indirectly via one or more other devices, components, wires, buses, networks (e.g., a wired network, a wireless network, or a combination thereof), etc. Two devices (or components) that are electrically coupled can be included in the same device or in different devices and can be connected via electronics, one or more connectors, or inductive coupling, as illustrative, non-limiting examples. In some implementations, two devices (or components) that are communicatively coupled, such as in electrical communication, can send and receive electrical signals (digital signals or analog signals) directly or indirectly, such as via one or more wires, buses, networks, etc. As used herein, "directly coupled" is used to describe two devices that are coupled (e.g., communicatively coupled, electrically coupled, or physically coupled) without intervening components.

FIG. 1 is a block diagram that illustrates a system 100 including a structure 102 and an antenna device 108 coupled (e.g., mounted) to the structure 102. In a particular implementation, the structure 102 includes an aircraft, spacecraft, watercraft, a land vehicle, or a stationary structure (such as a tower, a building, or a bridge). In the example illustrated in FIG. 1, the structure 102 includes a surface 104 to which the antenna device 108 is physically mounted. In some implementations, the surface 104 is a contoured or curved surface 104 of the structure 102. For example, when the structure 102 is a portion of an aircraft, the surface 104 can include an aerodynamic surface, such as a surface of a wing or a fuselage. In such implementations, materials used to form the antenna device 108 are pliable to conform to the curved surface 104.

In FIG. 1, the structure 102 at least partially encloses communication equipment 106. The communication equipment 106 includes, for example, a transmitter, a receiver, a transceiver, portions of a radar system, or other communication equipment that uses radio frequency waves to transmit or receive data. The communication equipment 106 is electrically coupled (e.g., connected) to the antenna device 108 to send and/or receive signals via the antenna device 108.

The antenna device 108 includes one or more conductive patch antenna elements 110 disposed on a surface of one or more first dielectric layers 114 of a first spacer structure 112. In a particular implementation, the conductive patch antenna element(s) 110 include slotted circular metal members (e.g., metal foil or metal layers). In other implementations, the conductive patch antenna element(s) 110 are metal members with a different shape or configuration, such as an unslotted circular patch, a bowtie patch, a spiral patch, an H-patch, an irregular shaped patch, etc. The specific shape of the conductive patch antenna elements 110 is selected based on the designed beam characteristics of the antenna device 108. To illustrate, an unslotted circular patch can be used to generate a linearly polarized signal; whereas, a slotted circular patch can be used to generate a circularly polarized signal.

Further, the size of each conductive patch antenna element 110 is selected based on a target operating frequency of the antenna device 108. To illustrate, using a circular conductive patch antenna element 110 as an example, a diameter of the circular conductive patch antenna element 110 can be calculated such that the resonant frequency of the conductive patch antenna element 110 coincides with (e.g., is equal to) the target operating frequency. The diameter calculated in this manner can be used as input to a model (e.g., a finite element model) as an initial estimate of the size of the conductive patch antenna element 110. Due to electromagnetic coupling and other effects, the resonant frequency of the conductive patch antenna element 110 in the actual antenna device 108 is influenced by the geometry of and/or position of other components of the antenna device 108. For example, the distance between the conductive feed line 116 and the conductive patch antenna element 110 influences the resonant frequency of the conductive patch antenna element 110. A numerical model (e.g., a finite element model) can be used to account for such effects in order to select the size of each conductive patch antenna element 110.

In FIG. 1, the first dielectric layer(s) 114 are part of a stack 150 of layers that together form a circuit board (e.g., a flexible circuit board). In this example, the stack 150 includes multiple dielectric layers, such as the first dielectric layer(s) 114 and one or more second dielectric layer layers 120. The stack 150 further includes one or more conductive layers, such as a layer corresponding to or including the conductive patch antenna element(s) 110, a layer corresponding to or including one or more conductive feed lines 116, and a layer of corresponding to including a ground plane 126. In some implementations, the stack 150 also includes one or more additional layers, such as one or more coating layers 132, other conductive layers, or other dielectric layers.

The conductive feed line(s) 116 include one or more circuit traces (e.g., conductive traces embedded within the circuit board) to communicate electrical signals. In particular examples, the conductive feed line(s) 116 include one or more conductive traces (e.g., copper, aluminum, or other metal traces) patterned on the first spacer structure 112 or formed on the second spacer structure 118. As described above, the spacing between the conductive feed line 116 and an associated conductive patch antenna element 110 influences the resonant frequency of the conductive patch antenna element 110. Accordingly, the spacing between the conductive feed line 116 and each conductive patch antenna element 110 is selected to enable the conductive patch antenna element 110 to resonate at or near a target operating frequency of the antenna device 108. As an example, a numerical model can be used to determine the spacing.

In the particular implementation illustrated in FIG. 1, the first spacer structure 112 includes the first dielectric layer(s) 114 separating the conductive feed line(s) 116 from the conductive patch antenna element(s) 110. The second spacer structure 118 includes the second dielectric layer(s) 120 spacing the conductive feed line(s) 116 apart from the ground plane 126. The second dielectric layer(s) 120 define one or more walls 122 of a cavity 124. The cavity 124 is gas-filled (e.g., includes air or another gas) and is positioned between the conductive feed line(s) 116 and the ground plane 126. For example, a normal vector extending from a particular location on a surface of the ground plane 126 to a particular location of one of the conductive feed lines 116 passes through the cavity 124. Stated another way, an imaginary line extending parallel to a direction 140 in FIG. 1 passes through a portion of a conductive feed line 116, the cavity 124, and a portion of the ground plane 126. The cavity 124 has a width (e.g., width 204 shown in FIG. 2B) between opposing walls 122, and the conductive feed line 116 has a width (e.g., width 202 shown in FIG. 2B) between opposing edges. Each width 202, 204 refers to a direction parallel to a surface of the ground plane 126 (or perpendicular to the direction 140). In some implementations, the width 204 of the cavity 124 is equal to or greater than the width 202 of the conductive feed line 116. In other implementations, the width 204 of the cavity 124 is less than the width 202 of the conductive feed line 116. The cavity 124 reduces dielectric losses between the conductive feed line(s) 116 and the ground plane 126. For high frequency applications, dielectric losses are the dominant losses of the antenna device 108; thus, reducing the dielectric losses between the conductive feed line 116 and the ground plane 126 increases the overall gain of the antenna device 108. The width 204 of the cavity 124 is selected to limit or mitigate (e.g., to minimize) dielectric losses with the constraint that the width 204 of the cavity 124 is small enough so as to not severely reduce the structural integrity of the second space structure 118.

In some implementations, the antenna device 108 includes the coating layer(s) 132. For example, in FIG. 1, the antenna device 108 includes coating layer(s) 132 overlying the conductive patch antenna element 110 to prevent or mitigate damage to the conductive patch antenna element 110 due to surface abrasion or accidental contact. Additionally, in FIG. 1, the antenna device 108 includes coating layer(s) 132 underlying the ground plane 126 to insulate the ground plane 126 from the structure 102, to protect the ground plane 126 from the structure 102 (e.g., from chemical or electrochemical degradation due to direct contact with the structure 102), to protect the antenna device 108 before the antenna device 108 is mounted to the structure 102, or a combination thereof.

Figure 2A:
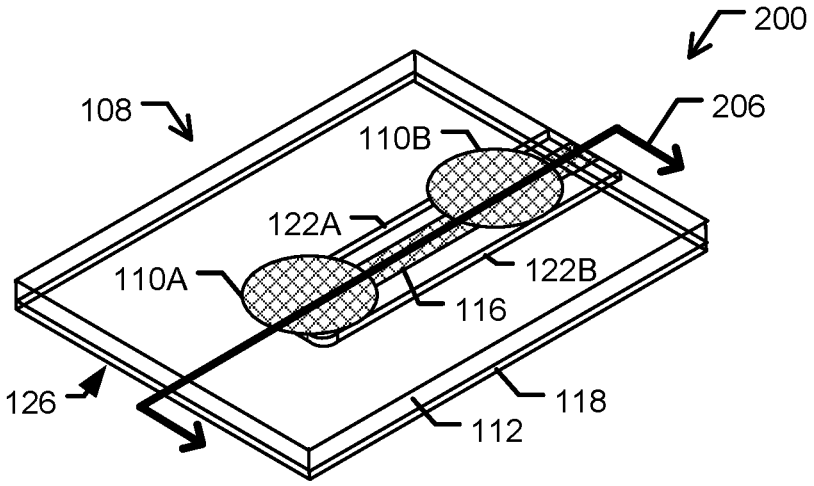
FIG. 2A is a diagram illustrating a perspective view of a first implementation of the antenna device of FIG. 1.
Figure 2B:
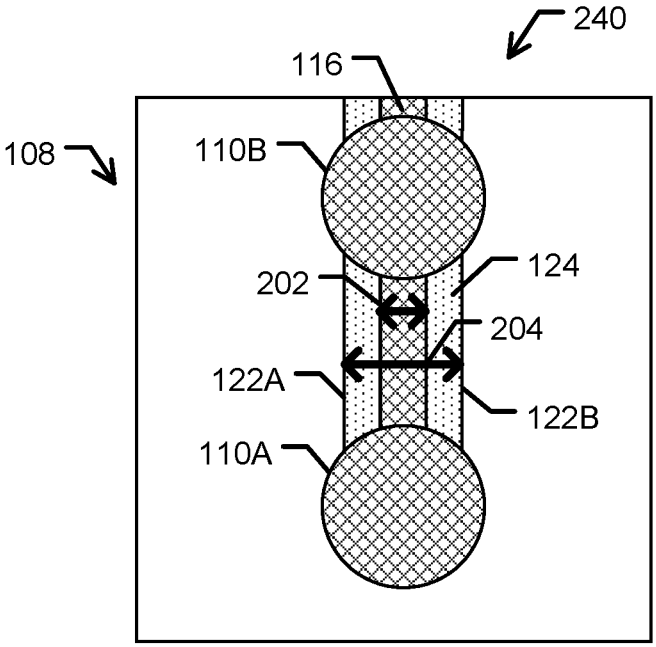
FIG. 2B is a diagram illustrating a top view of the first implementation of the antenna device of FIGS. 1 and 2A.
Figure 2C:
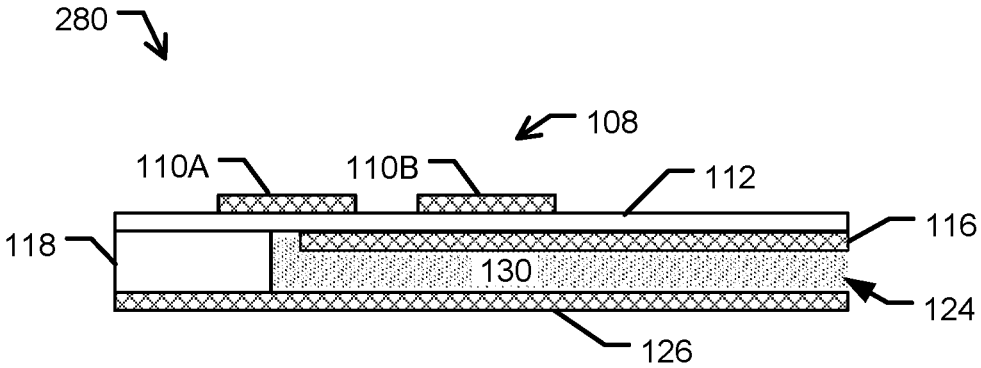
FIG. 2C is a diagram illustrating a cross-sectional view of the first implementation of the antenna device of FIGS. 1 and 2A.

In some implementations, the antenna device 108 includes an array of antenna elements (e.g., multiple conductive patch antenna elements 110 arranged in a structured or semi-structured pattern). In this context, the term "array" refers not merely to a square grid (e.g., points evenly spaced apart in two orthogonal directions), but can also include more complex patterns, such as radial patterns (e.g., points spaced apart along radial lines from an origin point), circumferential patterns (e.g., points spaced apart along concentric circles), grids based on polygons other than squares, or irregular patterns (e.g., patterns with points positioned at irregular intervals). In such implementations, one conductive feed line 116 can provide signal communication to a single conductive patch antenna element 110 or to multiple conductive patch antenna elements 110. For example, as illustrated in FIGS. 2A-2C, one conductive feed line 116 is arranged in signal communication with multiple conductive patch antenna elements 110A and 110B forming a series of conductive patch antenna elements 110. In contrast, in the FIGS. 4A and 4B, one conductive feed line 116 (such as conductive feed line 116D) is arranged in signal communication with one conductive patch antenna element 110 (e.g., conductive patch antenna element 110C).

Figure 3A:
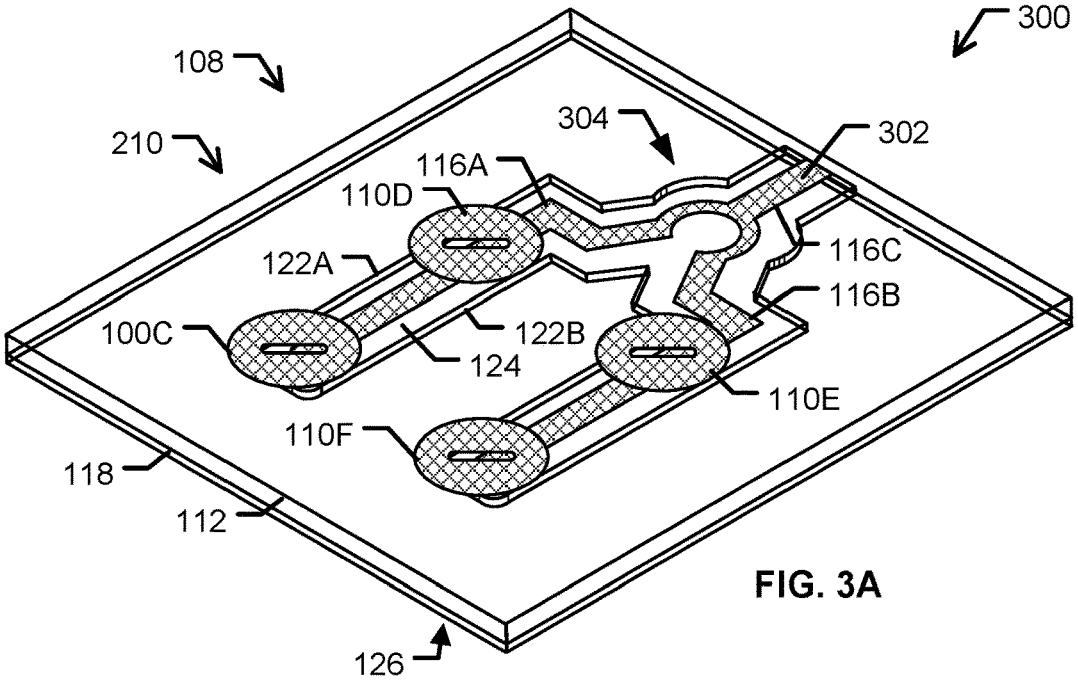
FIG. 3A is a diagram illustrating a perspective view of a second implementation of the antenna device of FIG. 1.
Figure 3B:
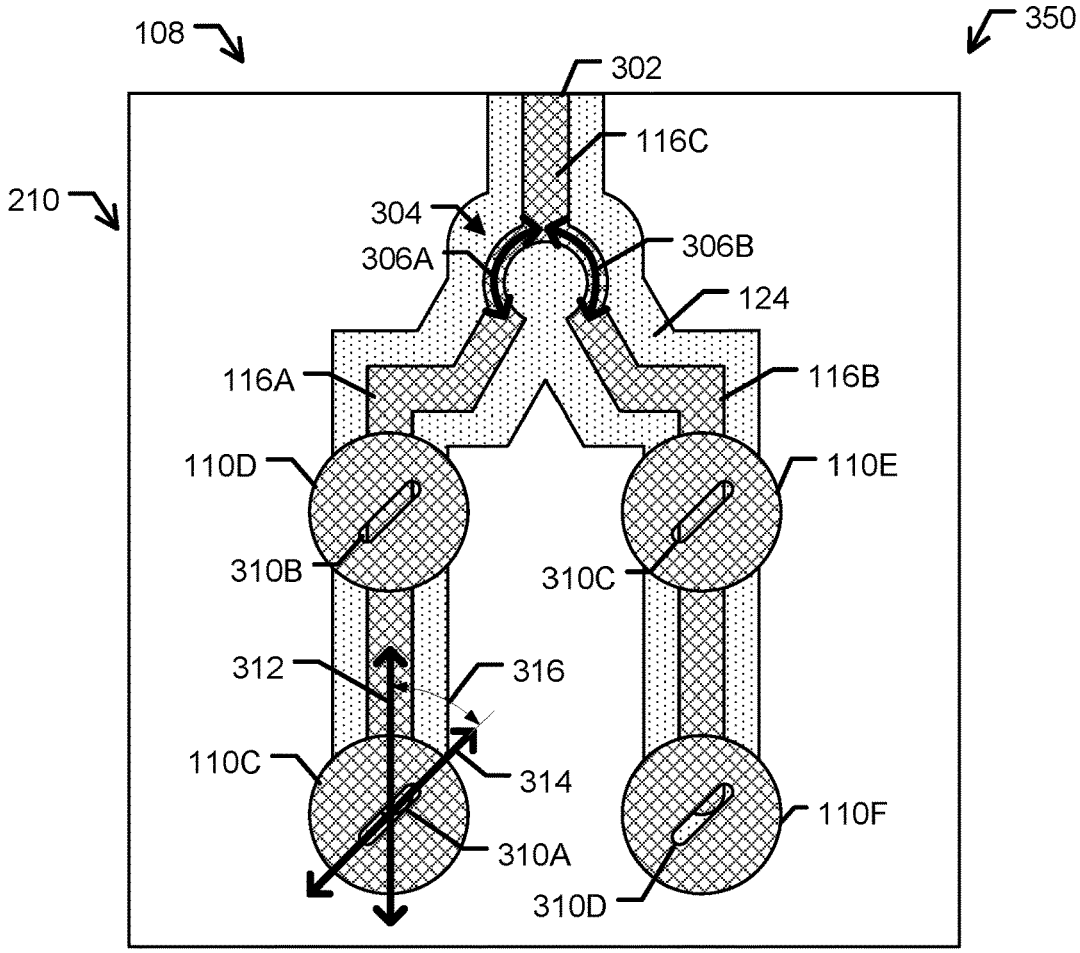
FIG. 3B is a diagram illustrating a top view of the second implementation of the antenna device of FIGS. 1 and 3A.

In some implementations, one conductive feed line 116 is coupled (e.g., connected) to two or more other conductive feed lines 116 to form a feed network (e.g., feed network 302 of FIGS. 3A and 3B). In such examples, a power divider (such as power divider structure 304 of FIGS. 3A and 3B) is used to connect the conductive feed lines 116 of the feed network 302. Such implementations enable more complex arrangements of the conductive patch antenna elements 110 of the antenna device 108. For example, some of the conductive patch antenna elements 110 can be arranged electrically in parallel to one another and others of the conductive patch antenna elements 110 can be arranged electrically in series with one another. FIGS. 3A and 3B illustrate an example of an array of conductive patch antenna elements 110C-110F in which some antenna elements are electrically in series with one another (e.g., the conductive patch antenna element 110C is electrically in series with the conductive patch antenna element 110D along the conductive feed line 116A), and other antenna elements are electrically in parallel with one another (e.g., the conductive patch antenna element 110C is electrically in parallel with the conductive patch antenna element 110F along conductive feed lines 116A and 116B).

Figure 4A:
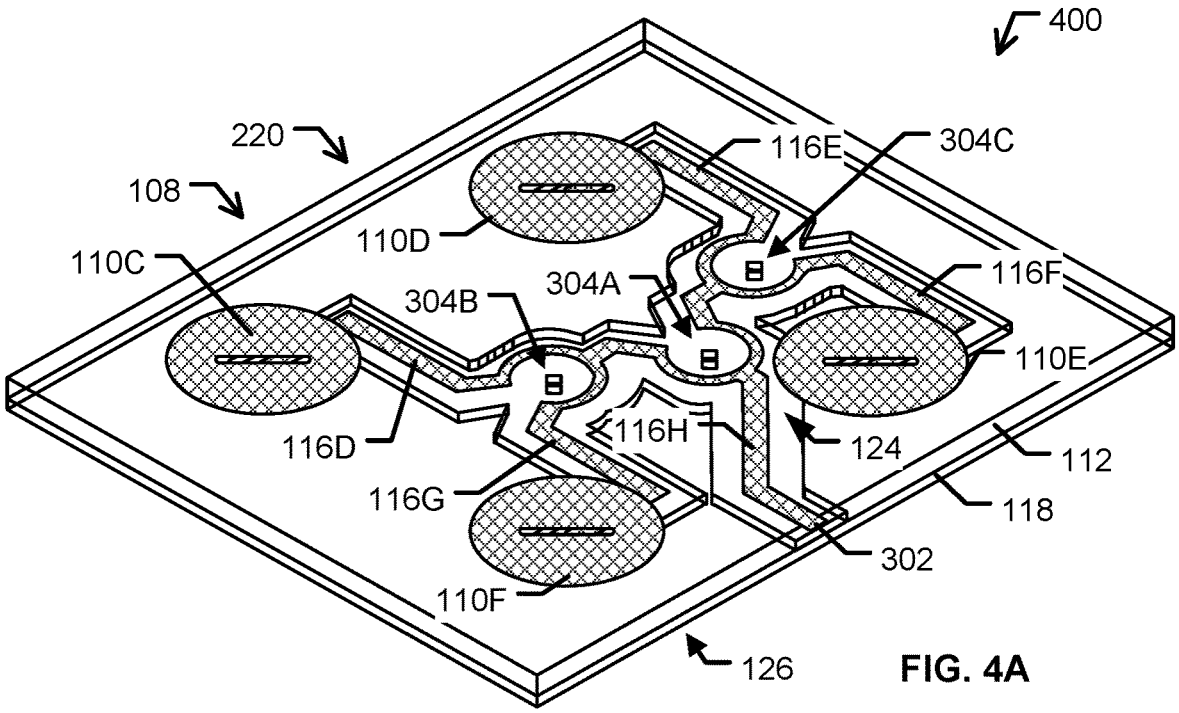
FIG. 4A is a diagram illustrating a perspective view of a third implementation of the antenna device of FIG. 1.
Figure 4B:
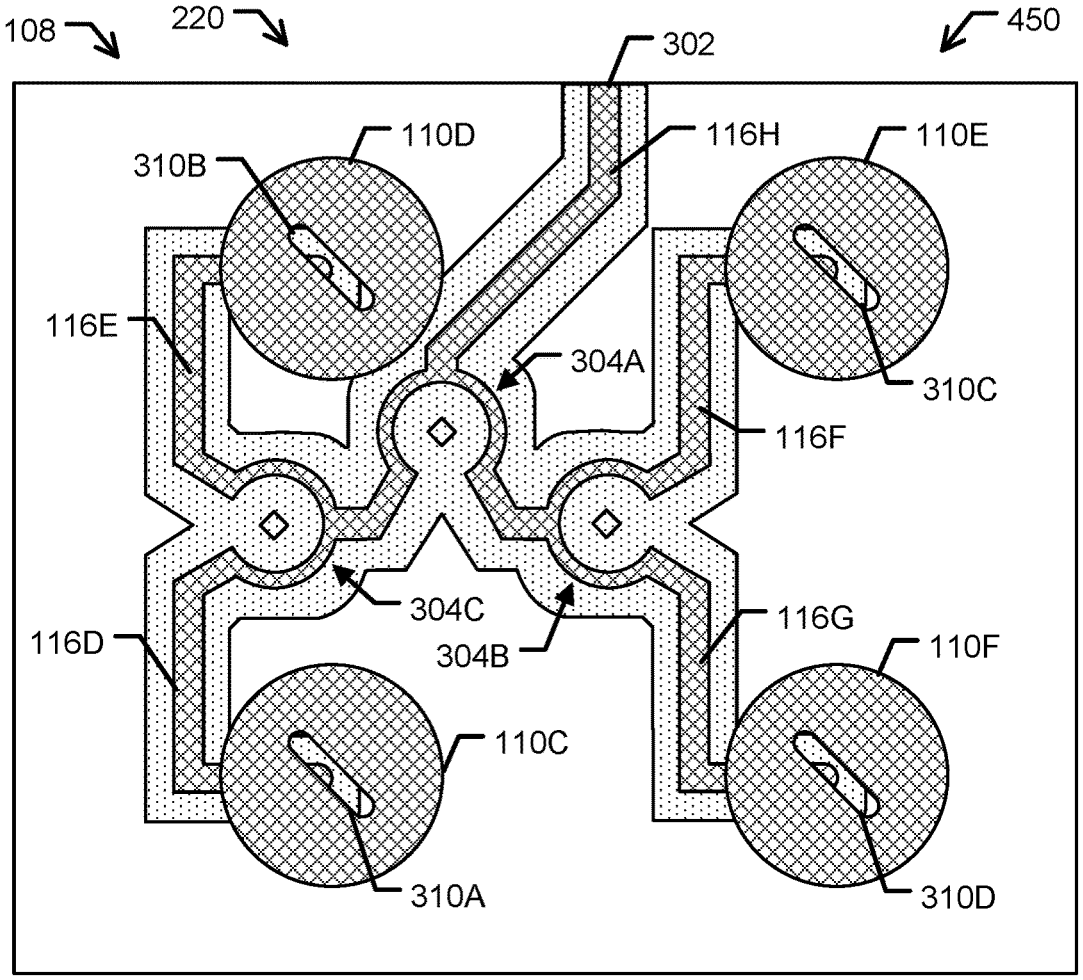
FIG. 4B is a diagram illustrating a top view of the third implementation of the antenna device of FIGS. 1 and 4A.

The use of power dividers can also enable arrangements of the conductive patch antenna elements 110 in an entirely electrically parallel configuration. FIGS. 4A and 4B illustrate an example in which each conductive patch antenna element 110C-110F is connected electrically in parallel with each other conductive patch antenna element 110C-110F.

In implementations in which the antenna device 108 includes more than one conductive feed line 116, the antenna device 108 can also include more than one cavity 124. In such implementations, each conductive feed line 116 is separated from the ground plane 126 via corresponding cavity 124. In alternative implementations, a single cavity 124 extends between the conductive feed lines 116 and the ground plane 126. In an example, the antenna device 108 includes a first conductive patch antenna element 110 (such as the conductive patch antenna element 110D of FIGS. 3A and 3B) and a first conductive feed line 116 (such as conductive feed line 116A) and further includes a second conductive patch antenna element 110 (such as the conductive patch antenna element 110E of FIGS. 3A and 3B) and a second conductive feed line 116 (such as conductive feed line 116B). In this example, the first spacer structure 112 separates the first conductive patch antenna element 110D from the first conductive feed line 116A, the first spacer structure 112 separates the second conductive patch antenna element 110E from the second conductive feed line 116B, and the cavity 124 (e.g., a single cavity 124) extends between the first conductive feed line 116A and the ground plane 126 and between the second conductive feed line 116B and the ground plane 126.

FIG. 2A-2C are diagrams illustrating various views of a first implementation of the antenna device 108 of FIG. 1. In particular, FIG. 2A illustrates a perspective view 200, FIG. 2B illustrates a top view 240, and FIG. 2C illustrates a cross-sectional view 280 along a cut line 206 illustrated in FIG. 2A.

FIGS. 2A-2C illustrate examples of the ground plane 126, the second spacer structure 118, the first spacer structure 112, the cavity 124, the walls 122A and 122B of the cavity 124, the conductive feed line 116, and two conductive patch antenna elements 110A and 110B. In the particular example illustrated in FIGS. 2A-2C, the conductive patch antenna elements 110A, 110B are solid circular elements (e.g., without slots) and are arranged in series with respect to a single conductive feed line 116. The cross-sectional view 280 in FIG. 2C shows the relative positions of the conductive feed line 116, the cavity 124, and the ground plane 126. As illustrated in the cross-sectional view 280, gas 130 within the cavity 124 is disposed between the conductive feed line 116 and the ground plane 126, which results in lower dielectric losses than would occur if the one or more of the second dielectric layers 120 of the second spacer structure 118 extended between the conductive feed line 116 and the ground plane 126.

FIGS. 3A and 3B are diagrams illustrating views of a second implementation of the antenna device 108 of FIG. 1. In particular, FIG. 3A illustrates a perspective view 300, and FIG. 3B illustrates a top view 350.

FIGS. 3A and 3B illustrate examples of the ground plane 126, the second spacer structure 118, the first spacer structure 112, the cavity 124, the walls 122A and 122B of the cavity 124. In addition, the FIGS. 3A and 3B illustrate multiple conductive feed lines 116A-116C coupled (e.g., connected) to one another via a power divider structure 304 to form a feed network 302.

In the particular example illustrated in FIGS. 3A and 3B, the conductive patch antenna elements 110C-110F are slotted circular elements arranged in an array 210 (e.g., a 2×2 array). In the array 210, two of the conductive patch antenna elements 110C and 110D are coupled in series with respect to a first conductive feed line 116A, and the other two conductive patch antenna elements 110E and 110F are coupled in series with respect to a second feed line 116B. Additionally, the conductive patch antenna elements 110C and 110D are coupled in parallel with respect to the other two conductive patch antenna elements 110E and 110F.

In the example illustrated in FIGS. 3A and 3B, a single cavity 124 extends beneath each of the feed lines 116A-116C and beneath the power divider structure 304. In other implementations, the antenna device 108 includes multiple cavities 124. For example, a first cavity 124 can extend between the first conductive feed line 116A and the ground plane 126, a second cavity 124 can extend between the second conductive feed line 116B and the ground plane 126, and a third cavity 124 can extend between the third conductive feed line 116C and the ground plane 126. In one such example, no cavity 124 is present beneath the power divider structure 304 (e.g., in an area between the power divider structure 304 and the ground plane 126). In another such example, a fourth cavity 124 is present beneath at least a portion of the power divider structure 304.

The top view 350 of FIG. 3B illustrates one example of orientations of slots 310 of the conductive patch antenna elements 110. The slot orientations illustrated are configured to facilitate transmission of or reception of circularly polarized signals. In FIG. 3B, each slot 310 has a major axis 314 that is disposed at an angle 316 with respect to a major axis 312 of an associated conductive feed line 116. For example, the major axis 314 of the slot 310A is angled with respect to the conductive feed line 116A. In the particular example illustrated, the angle 316 is approximately 45 degrees; however, in other implementations, the angle 316 is greater than or less than 45 degrees.

FIG. 3B also illustrates aspects of the power divider structure 304. As illustrated in FIG. 3B, the power divider structure 304 includes a first leg 306A extending between the third conductive feed line 116C and the first conductive feed line 116A and includes a second leg 306B extending between the third conductive feed line 116C and the second conductive feed line 116B. The legs 306 of the power divider structure 304 are designed to balance the power provided to each of the first and second conductive feed lines 116A and 116B from the third conductive feed line 116C. The legs 306 are also designed to impedance match the first and second conductive feed lines 116A and 116B with the third conductive feed line 116C. In a particular implementation, each leg 306 has a length that is approximately equal to one quarter of a wavelength of a signal that the antenna device 108 is designed to send or receive.

As an example, in some implementations, the power divider structure 304 includes a Wilkinson divider. In one such implementation, each conductive feed line 116 is a 50 ohm line and each leg 306 is a quarter wavelength 70 ohm line. This arrangement balances impedance to reduce reflections and provides balanced power to conductive patch antenna elements 110C-110F, which improves power throughput of the antenna device 108.

In FIGS. 3A and 3B, the conductive patch antenna elements 110C-F are arranged more or less on corners of a square (e.g., the array 210 is a square array). In other implementations, other spacings and relative positions of the conductive patch antenna elements 110 are used, e.g., to form a larger or smaller square, or to form a different geometric shape or array pattern. The spacing between the conductive patch antenna elements 110 influences beam direction of a beam formed by the array 210. For example, some spacings of the conductive patch antenna elements 110 tend to form a beam that is not perpendicular to a surface of the ground plane 126. Arranging the conductive patch antenna elements 110 electrically in parallel to one another can reduce this effect. For example, an electrically parallel array 220 of conductive patch antenna elements 110 (such as illustrated in FIGS. 4A and 4B) will tend to generate a more perpendicular beam than the beam generated by the array 210.

FIGS. 4A and 4B are diagrams illustrating views of a third implementation of the antenna device 108 of FIG. 1. In particular, FIG. 4A illustrates a perspective view 400, and FIG. 4B illustrates a top view 450.

FIGS. 4A and 4B illustrate examples of the ground plane 126, the second spacer structure 118, the first spacer structure 112, the cavity 124, the walls 122A and 122B of the cavity 124. In addition, the FIGS. 4A and 4B illustrate multiple conductive feed lines 116D-H coupled (e.g., connected) to one another via a set of power divider structures 304A-304C to form a feed network 302.

In the particular example illustrated in FIGS. 4A and 4B, the conductive patch antenna elements 110C-110F are slotted circular elements arranged in an array 220 (e.g., a 2×2 array). In the array 220, each conductive patch antenna element 110 is electrically in parallel with respect to each other conductive patch antenna elements 110. The positioning and spacing of the conductive patch antenna elements 110 in the example illustrated in FIGS. 4A and 4B is similar to the positioning and spacing of the conductive patch antenna elements 110 in the example illustrated in FIGS. 3A and 3B; however because the conductive patch antenna elements 110 of FIGS. 4A and 4B are electrically in parallel with one another, the antenna device 108 of FIGS. 4A and 4B is expected to generate a more perpendicular beam, which will result in higher gain of a main lobe of the beam.

FIGS. 5A, 5B, 5C, 5D, and 5E illustrate various stages of a process of manufacturing the antenna device 108 of FIG. 1 according to a particular implementation. In particular FIGS. 5A-5E illustrate five stage 500, 520, 540, 560, 580 during manufacturing of the antenna device 108. The stages 500, 520, 540, 560, 580 are illustrated in a cross-sectional view similar to the cross-sectional view 280 of FIG. 2C.

In the example of FIGS. 5A-5E, each of the first four stages 500, 520, 540 and 560 generates one or more layers of the structure of the antenna device 108, and the layers are assembled together in the fifth stage 580 to form the antenna device 108. In this example, the first four stages 500, 520, 540 and 560 can be performed one after the other or in parallel with one another, and the fifth stage 580 is performed after the first four stages 500, 520, 540 and 560 are complete. In other implementations, the layers of the antenna device 108 are manufactured in a layer-by-layer manner, such as by depositing and patterning materials one upon another to build up the layers of the antenna device 108.

In a first stage 500, a second stage 520, and a fourth stage 560 of the process illustrated in FIGS. 5A-5E, a conductive material is patterned on a dielectric layer 114 to form a portion of the antenna device 108. Each of these stages 500, 520, 560 can be performed using an additive process, a subtractive process, or a combination of additive and subtractive processes. As an example of an additive process, a conductive material (such as a metal, a conductive polymer, or a conductive ink) is deposited onto a surface of a respective dielectric layer 114 to form a portion of the antenna device 108. The conductive material is deposited via printing, electroplating, sputtering, or another deposition process (such as chemical vapor deposition (CVD), physical vapor deposition (PVD), etc.). The dielectric layer 114 includes one or more polymers, a liquid crystal polymers, laminates, ceramics, or combinations thereof.

As an example of a subtractive process, a starting material for one of the stages 500, 520, 560 includes a dielectric layer 114 with an attached conductive layer (such as a metal foil or a sheet of another conductive material) on at least one surface. In this example, portions of the conductive layer are removed to form a portion of the antenna device 108. For example, portions of the conductive layer can be removed via scribing, peeling, wet etching, laser ablation, or another subtractive process.

As an example of a combined additive and subtractive process, a conductive layer (such as a metal, a conductive polymer, or a conductive ink) is deposited on or attached to a dielectric layer 114. Subsequently, portions of the conductive layer are removed to pattern the conductive layer to form a portion of the antenna device 108.

Figure 5A:
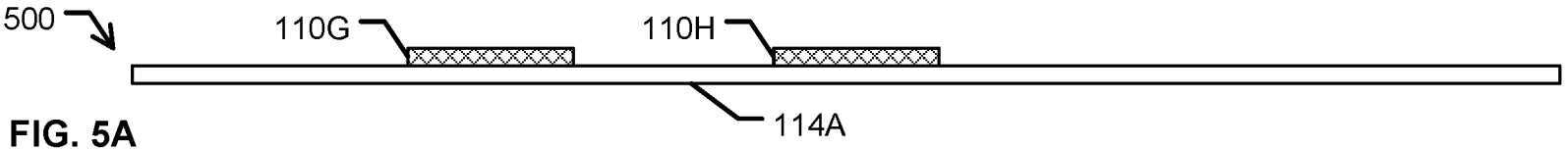
FIGS. 5A, 5B, 5C, 5D, and 5E illustrate various stages of a process of manufacturing the antenna device of FIG. 1 according to a particular implementation.

In the first stage 500 of FIG. 5A, one or more conductive patch antenna elements 110, such as conductive patch antenna elements 110G and 110H are formed on a first dielectric layer 114A. The conductive patch antenna elements 110G and 110H are shaped, positioned, and oriented on the first dielectric layer 114A to form an array of antenna elements having particular characteristics based on signals to be transmitted or received using the antenna device 108, as explained above. For example, the size of the conductive patch antenna elements 110G and 110H is based, at least in part, on a target operating frequency of the antenna device 108. As another example, a shape of the conductive patch antenna elements 110G and 110H is based, at least in part, on a polarization of the signals to be transmitted or received using the antenna device 108. Although FIG. 5A only shows two conductive patch antenna elements 110G and 110H, in other implementations, more than two or fewer than two conductive patch antenna elements 110G and 110H are formed on the dielectric layer 114A in the first stage 500.

Figure 5B:
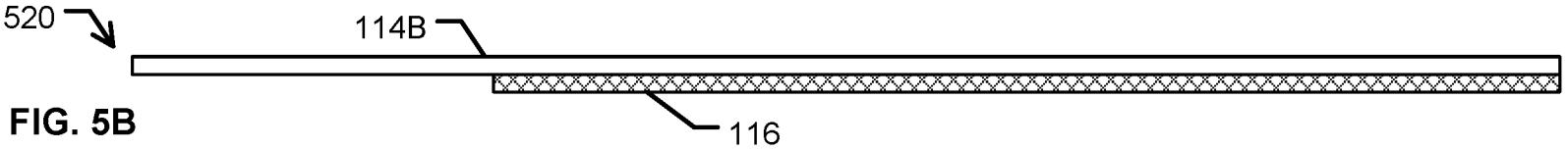

In the second stage 520 of FIG. 5B, one or more conductive feed lines 116 are formed on a second dielectric layer 114B. In some implementations, two or more conductive feed lines 116 are formed and interconnected by one or more power divider structures 304 to form a feed network 302. The one or more conductive feed lines 116 are shaped, positioned, and oriented on the second dielectric layer 114B to align with the conductive patch antenna elements 110 on the first dielectric layer 114A. For example, each of the one or more conductive feed lines 116 is disposed such that a major axis 312 of the respective conductive feed line 116 has a particular angle 316 with respect to a feature of one or more of the conductive patch antenna elements 110. To illustrated, the major axis 312 of a particular conductive feed line 116 can have a specified angle 316 with respect to slots of one or more of the conductive patch antenna elements 110.

Figure 5C:
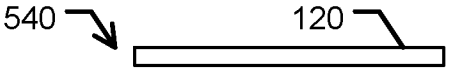

In the third stage 540 of FIG. 5C, one or more dielectric layer 120 are patterned to space the conductive feed line(s) 116 apart from the ground plane 126 to define the cavity 124. In a particular implementation, one or more sheets or layers of dielectric material are cut, etched, or otherwise subtractively patterned to form the dielectric layer(s) 120. In another particular implementation, one or more sheets or layers of dielectric material are deposited or otherwise additively patterned to form the dielectric layer(s) 120. The dielectric layer(s) 120 have a thickness based on a depth of the cavity 124 (e.g., a distance between a lower surface of a conductive feed line 116 and an upper surface of the ground plane 126 in the view illustrated in FIG. 5E). In some implementations, as illustrated in FIG. 5E, the dielectric layer(s) 120 are combined with one or more other layers to form the second spacer structure 118. Additionally, the dielectric layer(s) 120 are patterned to have edges corresponding to the walls 122 of the cavity 124.

Figure 5D:
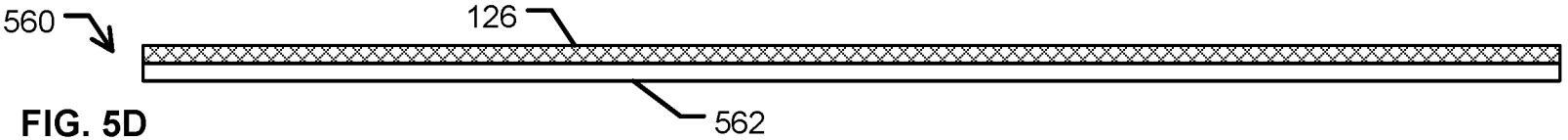
Figure 5E:
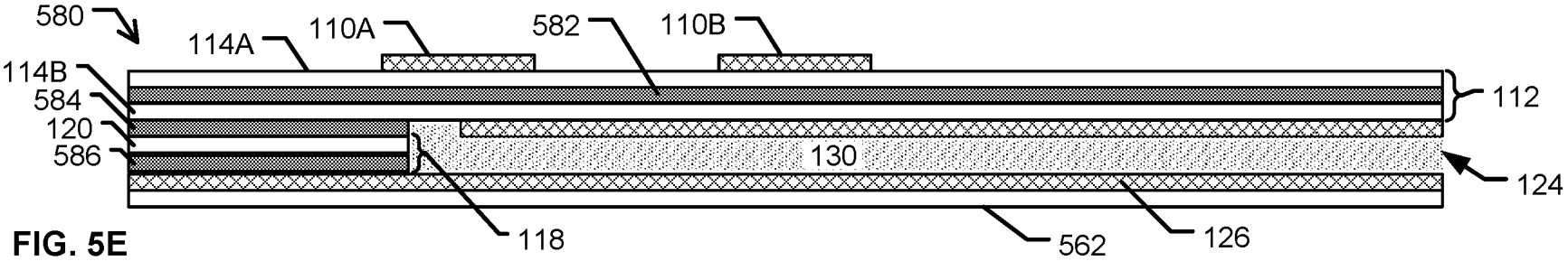

In the fourth stage 560 of FIG. 5D, the ground plane 126 is formed. In the example illustrated, the ground plane 126 is formed on a substrate 562. In some implementations, the substrate 562 corresponds to or includes the coating layer(s) 132 underlying the ground plane 126. In other implementations, the ground plane 126 is formed on a different substrate, such as an insulating layer or a temporary support structure (e.g., face paper) that is removed during manufacture of the antenna device 108 or during installation of the antenna device 108 on the surface 104 of the structure 102. In some implementations, the substrate 562 is formed of or includes the same material(s) as the dielectric layer(s) 114A, 114B, or 120.

In the fifth stage 580, the various portions of the antenna device 108 formed in the other stages 500, 520, 540, 560 are aligned and assembled to form the antenna device 108. In the particular example illustrated in FIG. 5E, the various portions of the antenna device 108 are assembled together using one or more adhesive layers, such as first adhesive layer 582, a second adhesive layer 584, and adhesive layer 586. For example, the adhesive layer(s) 582-586 can include pressure sensitive adhesives, epoxies, or other adhesives. In some implementations, a lamination process is used to apply heat and pressure to a stack of layer including the various portions of the antenna device 108 formed via the other stages 500, 520, 540, 560 to cure the adhesive layer(s) 582-586.

Although FIG. 5E shows three adhesive layers 582-586, in other implementations, fewer than three adhesive layers or more than three adhesive layers are used. For example, in some implementations one or more of the dielectric layers 114A, 114B, 120 include a thermoplastic polymer. In such implementations, heat applied to the stack of layers during the lamination process softens the thermoplastic polymer sufficiently that the thermoplastic polymer adheres to one or more adjacent layers. To illustrate, the first and second dielectric layers 114A adhere to one another. Alternatively, or in addition, the second dielectric layer 114B and the one or more dielectric layers 120 of the second spacer structure 118 adhere to one another. Alternatively, or in addition, the one or more dielectric layers 120 of the second spacer structure 118 adhere to the ground plane 126.

Figure 6A:
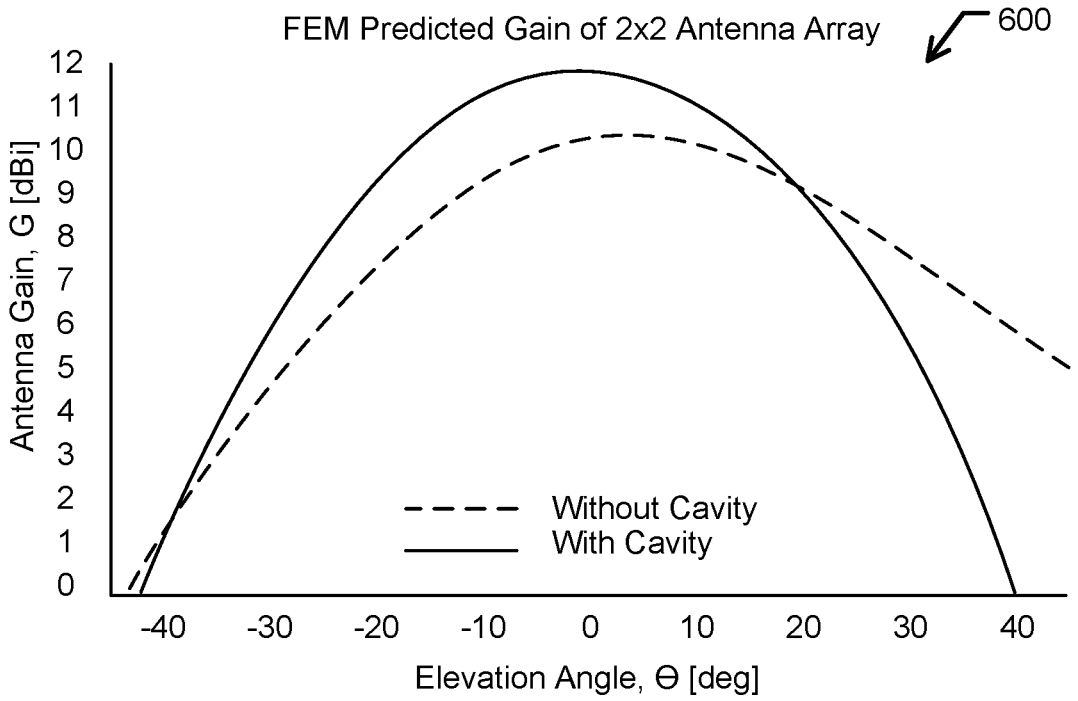
FIGS. 6A and 6B are charts illustrating predicted characteristics of a particular implementation of the antenna device of FIG. 1 arranged in a 2×2 antenna array.
Figure 6B:
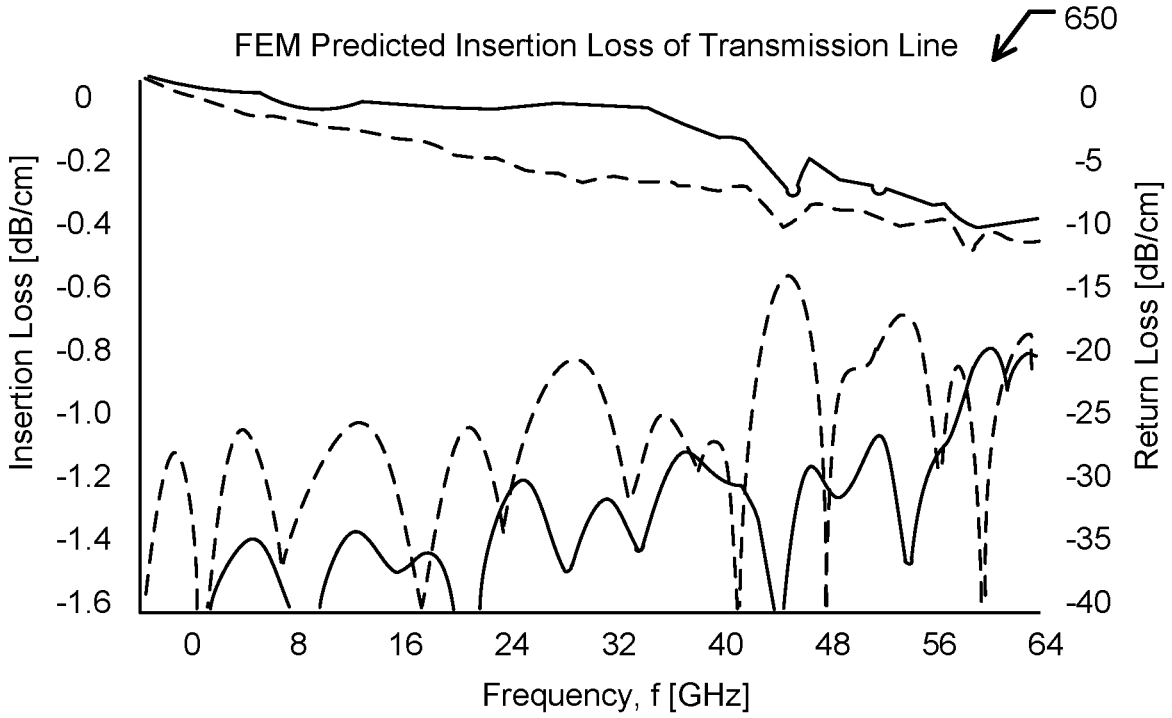

FIGS. 6A and 6B are charts 600 and 650, respectively, illustrating predicted characteristics of a particular implementation of the antenna device 108 of FIG. 1. The predicted characteristics illustrated were determined using finite element modeling (FEM) of a 2×2 antenna array with a cavity 124 between a conductive feed line 116 and a ground plane 126 of the antenna array and are contrasted with an identically configured 2×2 antenna array without a cavity between a conductive feed line and a ground plane.

The chart 600 of FIG. 6A shows predicted gain at various elevation angles, θ, for the modeled 2×2 array. As shown in FIG. 6A, the peak gain for the 2×2 array with the cavity 124 included is about 2 dBi more than the peak gain for the 2×2 array without the cavity 124. Additionally, the peak gain for the 2×2 array with the cavity 124 occurs closer to a zero (0) degree elevation angle, indicating a more perpendicular beam.

In the chart 650 of FIG. 6B, an upper pair of lines show predicted insertion losses of the transmission line of the modeled 2×2 arrays at various frequencies, and a lower pair of lines show predicted return losses of the transmission line of the modeled 2×2 arrays at the various frequencies. As shown in FIG. 6B, the transmission losses for a 2×2 array that includes the cavity 124 are less than the transmission losses for a 2×2 array without the cavity 124 across a wide range of frequencies. To illustrate, at 24 GHz, the predicted insertion loss of the 2×2 array with the cavity 124 is about 0.10 dB/cm; whereas, the predicted insertion loss of the 2×2 array without the cavity at 24 GHz is about 0.23 dB/cm. Additionally, at 40 GHz, the predicted insertion loss of the 2×2 array with the cavity 124 is about 0.12 dB/cm; whereas, the predicted insertion loss of the 2×2 array without the cavity at 40 GHz is about 0.32 dB/cm. Thus, the modeling confirms that the cavity 124 between the conductive feed line(s) 116 and the ground plane 126 reduces transmission losses in the conductive feed line(s) 116 resulting in high gain for the antenna device 108 as a whole. The return loss for the transmission line with the cavity 124 is less than 20 dB across the frequency range of 64 GHz illustrated, which means less than 1 percent of the power inserted into the antenna device 108 is being reflected back.

Figure 7:
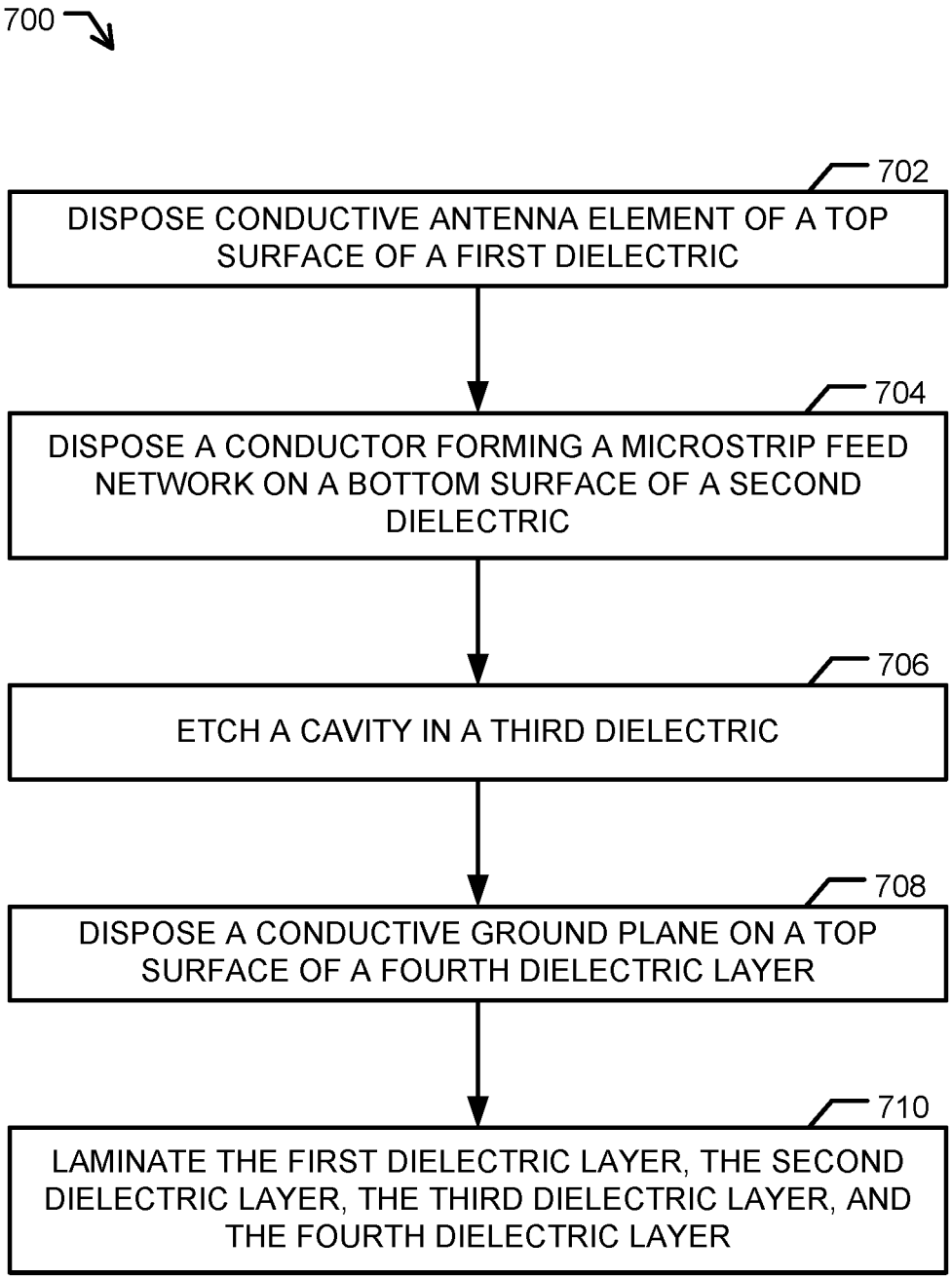
FIG. 7 is a flowchart of a particular implementation of a method of forming the antenna device of FIG. 1.

FIG. 7 is a flowchart of a particular implementation of a method 700 of forming the antenna device 108 of FIG. 1. The method 700 includes, at 702, disposing a conductive antenna element a top surface of a first dielectric. For example, referring to FIG. 5A, the conductive patch antenna elements 110G and 110H are disposed on the first dielectric layer 114A using an additive process or a subtractive process.

The method 700 also includes, at 704, disposing a conductor forming a microstrip feed network on a bottom surface of a second dielectric. For example, referring to FIG. 5B, one or more conductive feed lines 116 (which can also be referred to as microstrip feeds) are disposed on the second dielectric layer 114B using an additive process or a subtractive process. In some implementations, two or more of the conductive feed lines 116 can be joined to form a feed network.

The method 700 further includes, at 706, etching a cavity in a third dielectric. For example, referring to FIG. 5C, the dielectric layer 120 is patterned using an additive process or a subtractive process, such as etching.

The method 700 also includes, at 708, disposing a conductive ground plane on a top surface of a fourth dielectric layer. For example, referring to FIG. 5D, the ground plane 126 is disposed on the substrate 562 (which can include or correspond to a dielectric layer) using an additive process or a subtractive process.

The method 700 includes, at 710, laminating the first dielectric layer, the second dielectric layer, the third dielectric layer, and the fourth dielectric layer. For example, referring to FIG. 5E, the various dielectric layers 114A, 114B, 120, and 562 and the various conductive components attached thereto are stacked together with adhesive layers 582-586, aligned, and laminated together to form the antenna device 108.

Figure 8:
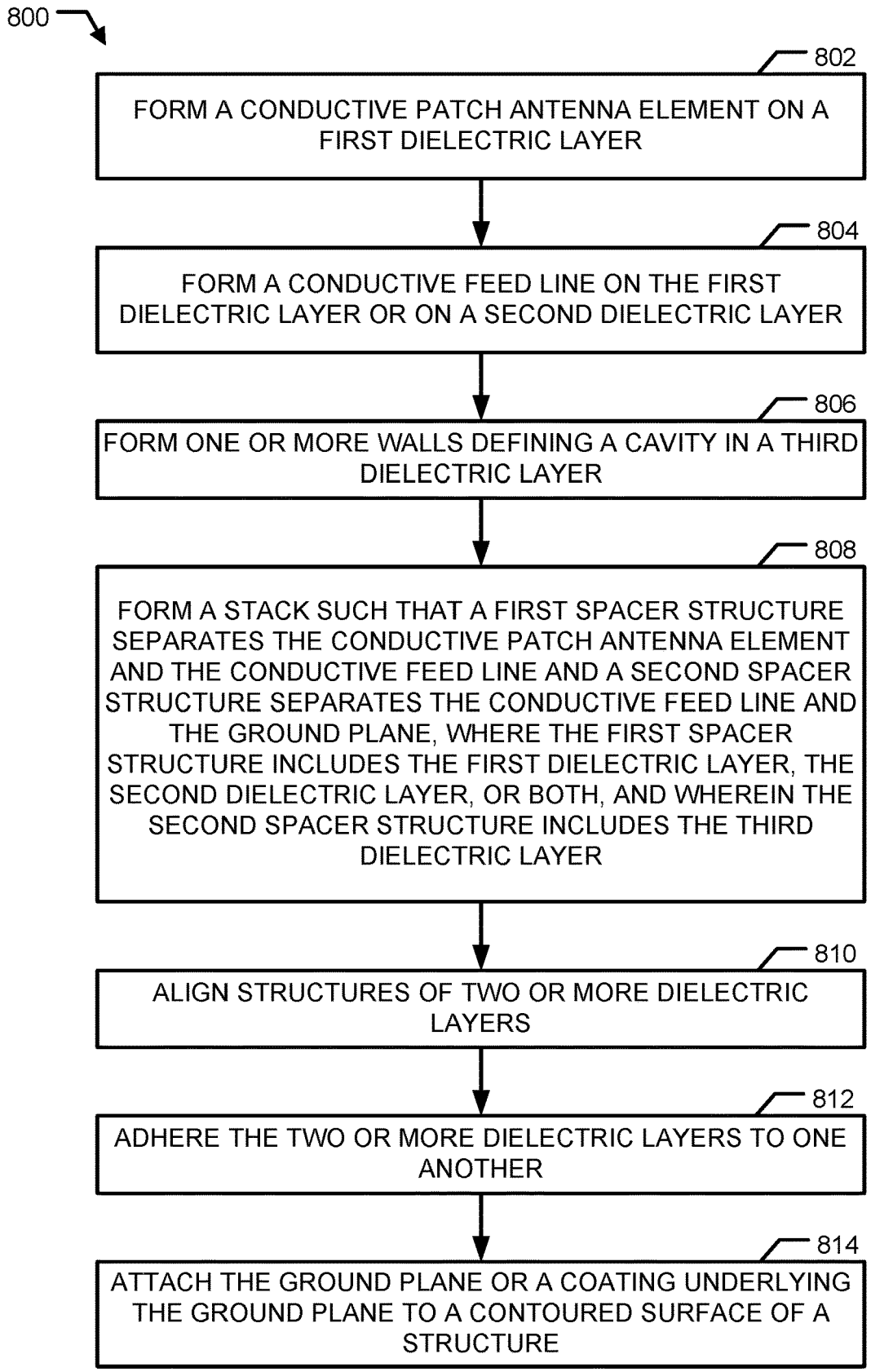
FIG. 8 is a flowchart of another particular implementation of a method of forming the antenna device of FIG. 1.

FIG. 8 is a flowchart of another particular implementation of a method 800 of forming the antenna device 108 of FIG. 1. The method 800 includes, at 802, forming a conductive patch antenna element on a first dielectric layer. For example, the conductive patch antenna elements 110G and 110H of FIG. 5A are formed on the first dielectric layer 114A using an additive process or a subtractive process.

The method 800 also includes, at 804, forming a conductive feed line on the first dielectric layer or on a second dielectric layer. For example, in the implementation illustrated in FIG. 5B, one or more conductive feed lines 116 are formed on the second dielectric layer 114B using an additive process or a subtractive process. In other implementations, the one or more conductive feed lines 116 are formed on a surface of the first dielectric layer 114A that is opposite the conductive patch antenna elements 110G and 110H using an additive process or a subtractive process.

The method 800 further includes, at 806, forming one or more walls defining a cavity in a third dielectric layer. For example, the dielectric layer 120 of FIG. 5C is patterned (using an additive process or a subtractive process) to define the walls 122 of the cavity 124.

The method 800 also includes, at 808, forming a stack such that a first spacer structure separates the conductive patch antenna element and the conductive feed line and a second spacer structure separates the conductive feed line and the ground plane. The first spacer structure includes the first dielectric layer, the second dielectric layer, or both, and the second spacer structure includes the third dielectric layer. For example, the dielectric layers 114A, 114B, 120, the adhesive layers 582-586, the substrate 562 and the various conductive components attached thereto are stacked together in FIG. 5E. Additionally, in FIG. 5E, a first spacer structure 112 includes the first dielectric layer 114A, the second dielectric layer 114B, and the adhesive layer 582. Further, the second spacer structure 118 in FIG. 5E includes the dielectric layer 120 and the adhesive layers 584 and 586.

In some implementations, the method 800 further includes, at 810, aligning structures of two or more of the dielectric layers. For example, the dielectric layers 114A, 114B, 120, adhesive layers 582-586, and the substrate 562 can be aligned to that the conductive patch antenna elements 110 are aligned with (e.g., overlie) respective conductive feed lines 116, and the conductive feed lines 116 are separated from the ground plane 126 by a cavity 124.

In some implementations, the method 800 also includes, at 812, adhering the two or more dielectric layers to one another. For example, the adhesive layers 582-586 can be cured. Alternative, in some implementations, no adhesive is used and the various dielectric layers are heated and softened to cause them to adhere to other adjacent structures of the antenna device 108.

The method 800 further includes, at 814, attaching the ground plane or a coating underlying the ground plane to a contoured surface of a structure. For example, after forming the antenna device 108, the antenna device 108 can be adhered to the surface 104 of a structure 102, such as an aircraft, a spacecraft, a watercraft, or a land vehicle. In some implementations, the antenna device 108 is pliable to enable the antenna device 108 to be adhered to a curved surface, such as an aerodynamic surface of an aircraft.

Aspects of the disclosure can be described in the context of an example of a vehicle. A particular example of a vehicle is an aircraft 900 as shown in FIG. 9.

Figure 9:
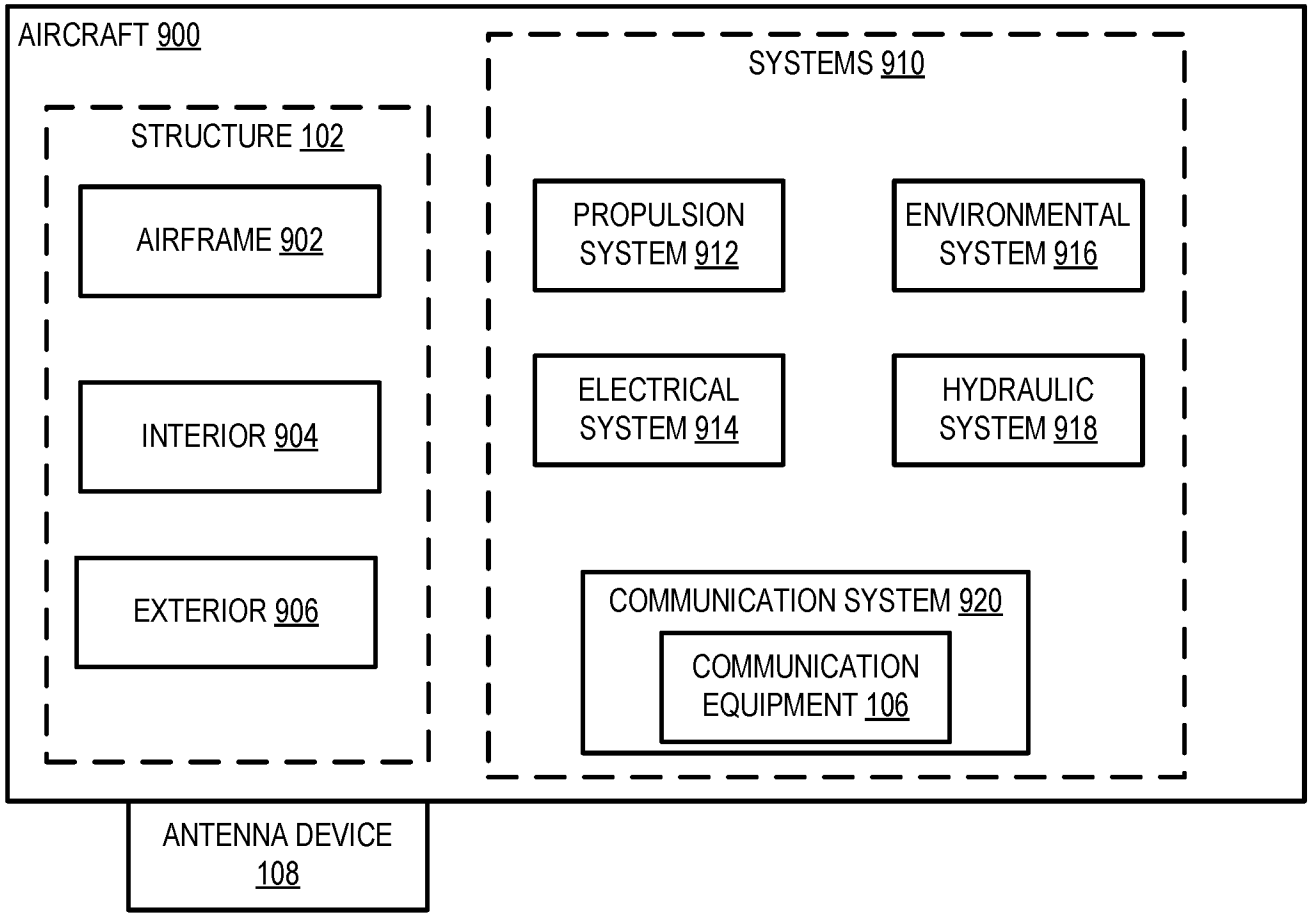
FIG. 9 is a block diagram of an example of an aircraft including the antenna device of FIG. 1 according to a particular implementation.

In the example of FIG. 9, the aircraft 900 includes an airframe 902 with a plurality of systems 910, an interior 904, and an exterior 906. The airframe 902, the interior 904, and the exterior 906 are included within or correspond to a structure 102. Examples of the plurality of systems 910 include one or more of a propulsion system 912, an electrical system 914, an environmental system 916, a hydraulic system 918, and a communication system 920. The communication system 920 includes the communication equipment 106, which is connected to the antenna device 108. In other implementation, more, fewer, or different systems 910 are included.

Further, the disclosure comprises embodiments according to the following clauses:

Clause 1. An antenna device, comprising: a conductive patch antenna element; a conductive feed line, wherein the conductive feed line and the conductive patch antenna element are separated by one or more first dielectric layers; and a ground plane, wherein the ground plane is separated from the conductive feed line by a spacer structure defining one or more walls of a cavity between the conductive feed line and the ground plane and including one or more second dielectric layers.

Clause 2. The antenna device of clause 1, further comprising one or more additional conductive patch antenna elements separated from the conductive feed line by the one or more first dielectric layers.

Clause 3. The antenna device of any of clauses 1 or 2, further comprising: a second conductive patch antenna element; and a second conductive feed line, wherein the one or more first dielectric layers separate the second conductive patch antenna element and the second conductive feed line, wherein the cavity extends between the second conductive feed line and the ground plane.

Clause 4. The antenna device of any of clauses 1 to 3, further comprising a power divider structure connecting the conductive feed line and the second conductive feed line to a third conductive feed line.

Clause 5. The antenna device of any of clauses 1 to 4, wherein the conductive patch antenna element comprises a slotted circular metal member.

Clause 6. The antenna device of any of clauses 1 to 5, wherein the conductive feed line has a first width along a direction parallel to a surface of the ground plane, wherein opposing walls of the cavity are separated by a second width in the direction parallel to the surface of the ground plane, and wherein the second width is greater than the first width.

Clause 7. The antenna device of any of clauses 1 to 6, further comprising gas disposed within the cavity.

Clause 8. The antenna device of clause 7, wherein the gas is air.

Clause 9. The antenna device of any of clauses 1 to 8, further comprising one or more first adhesive layers attached to the one or more first dielectric layers and one or more second adhesive layers attached to one or more second dielectric layers to form the spacer structure.

Clause 10. The antenna device of any of clauses 1 to 9, further comprising one or more coating layers overlying the conductive patch antenna element, underlying the ground plane, or both.

Clause 11. The antenna device of any of clauses 1 to 10, wherein materials of the conductive patch antenna element, the conductive feed line, the one or more first dielectric layers, the ground plane, and the spacer structure are pliable to conform to a curved surface.

Clause 12. A method of forming an antenna device, the method comprising: forming a conductive patch antenna element on a first dielectric layer; forming a conductive feed line on the first dielectric layer or on a second dielectric layer; forming one or more walls defining a cavity in a third dielectric layer; and forming a stack such that a first spacer structure separates the conductive patch antenna element and the conductive feed line and a second spacer structure separates the conductive feed line and the ground plane, wherein the first spacer structure includes the first dielectric layer, the second dielectric layer, or both, and wherein the second spacer structure includes the third dielectric layer.

Clause 13. The method of clause 12, wherein the conductive patch antenna element is formed by subtractively patterning a conductive material on the first dielectric layer to define a slotted circular member.

Clause 14. The method of any of clauses 12 or 13, wherein the conductive patch antenna element is formed by adding a conductive material to a surface of the first dielectric layer to define a slotted circular member.

Clause 15. The method of any of claims 12 to 14, wherein the conductive feed line is formed by subtractively patterning a conductive material on the second dielectric layer to define a plurality of traces interconnected by one or more power divider structures.

Clause 16. The method of any of claims 12 to 15, wherein the conductive feed line is formed by adding a conductive material to a surface of the second dielectric layer to define a plurality of traces interconnected by one or more power divider structures.

Clause 17. The method of any of claims 12 to 16, wherein forming the stack includes: aligning structures of two or more dielectric layers; and adhering the two or more dielectric layers to one another.

Clause 18. The method of any of claims 12 to 17, further comprising attaching the ground plane or a coating underlying the ground plane to a contoured surface of a structure.

Clause 19. The method of any of claims 12 to 18, wherein the structure is a portion of an aircraft.

Clause 20. A system comprising: a structure defining a surface; communication equipment at least partially within the structure; and an antenna device physically coupled to the surface of the structure and electrically coupled to the communication equipment, the antenna device comprising: a conductive patch antenna element disposed on a surface of a circuit board; a conductive feed line embedded within the circuit board; a ground plane; and a spacer structure separating the conductive feed line and the ground plane, the spacer structure defining one or more walls of a cavity between the conductive feed line and the ground plane and including one or more dielectric layers.

Clause 21. The system of clause 20, wherein the structure comprises an aircraft, a spacecraft, a watercraft, or a land vehicle.

Clause 22. The system of any of clauses 20 or 21, wherein the antenna device further comprises one or more additional conductive patch antenna elements separated from the conductive feed line by the one or more first dielectric layers.

Clause 23. The system of any of clauses 20 to 22, wherein the antenna device further comprises: a second conductive patch antenna element; and a second conductive feed line, wherein the one or more first dielectric layers separate the second conductive patch antenna element and the second conductive feed line, wherein the cavity extends between the second conductive feed line and the ground plane.

Clause 24. The system of any of clauses 20 to 23, wherein the antenna device further comprises a power divider structure connecting the conductive feed line and the second conductive feed line to a third conductive feed line.

Clause 25. The system of any of clauses 20 to 24, wherein the conductive patch antenna element comprises a slotted circular metal member.

Clause 26. The system of any of clauses 20 to 25, wherein the conductive feed line has a first width along a direction parallel to a surface of the ground plane, wherein opposing walls of the cavity are separated by a second width in the direction parallel to the surface of the ground plane, and wherein the second width is greater than the first width.

Clause 27. The system of any of clauses 20 to 26, wherein the antenna device further comprises gas disposed within the cavity.

Clause 28. The system of clause 27, wherein the gas is air.

Clause 29. The system of any of clauses 20 to 28, wherein the antenna device further comprises one or more first adhesive layers attached to the one or more first dielectric layers and one or more second adhesive layers attached to one or more second dielectric layers to form the spacer structure.

Clause 30. The system of any of clauses 20 to 29, wherein the antenna device further comprises one or more coating layers overlying the conductive patch antenna element, underlying the ground plane, or both.

Clause 31. The system of any of clauses 20 to 30, wherein materials of the conductive patch antenna element, the conductive feed line, the one or more first dielectric layers, the ground plane, and the spacer structure are pliable to conform to a curved surface.

The illustrations of the examples described herein are intended to provide a general understanding of the structure of the various implementations. The illustrations are not intended to serve as a complete description of all of the elements and features of apparatus and systems that utilize the structures or methods described herein. Many other implementations may be apparent to those of skill in the art upon reviewing the disclosure. Other implementations may be utilized and derived from the disclosure, such that structural and logical substitutions and changes may be made without departing from the scope of the disclosure. For example, method operations may be performed in a different order than shown in the figures or one or more method operations may be omitted. Accordingly, the disclosure and the figures are to be regarded as illustrative rather than restrictive.

Moreover, although specific examples have been illustrated and described herein, it should be appreciated that any subsequent arrangement designed to achieve the same or similar results may be substituted for the specific implementations shown. This disclosure is intended to cover any and all subsequent adaptations or variations of various implementations. Combinations of the above implementations, and other implementations not specifically described herein, will be apparent to those of skill in the art upon reviewing the description.

The Abstract of the Disclosure is submitted with the understanding that it will not be used to interpret or limit the scope or meaning of the claims. In addition, in the foregoing Detailed Description, various features may be grouped together or described in a single implementation for the purpose of streamlining the disclosure. Examples described above illustrate but do not limit the disclosure. It should also be understood that numerous modifications and variations are possible in accordance with the principles of the present disclosure. As the following claims reflect, the claimed subject matter may be directed to less than all of the features of any of the disclosed examples. Accordingly, the scope of the disclosure is defined by the following claims and their equivalents.

What is claimed is:

1. An antenna device comprising:

a conductive patch antenna element;

a conductive feed line, wherein the conductive feed line and the conductive patch antenna element are separated by one or more first dielectric layers; and a ground plane, wherein the ground plane is separated from the conductive feed line by a spacer structure defining one or more walls of a cavity between the conductive feed line and the ground plane and including one or more second dielectric layers, wherein the ground plane is separated from the conductive patch antenna element by the conductive feed line.

2. The antenna device of claim 1, further comprising one or more additional conductive patch antenna elements separated from the conductive feed line by the one or more first dielectric layers.

3. The antenna device of claim 1, further comprising:

a second conductive patch antenna element; and a second conductive feed line, wherein the one or more first dielectric layers separate the second conductive patch antenna element and the second conductive feed line, wherein the cavity extends between the second conductive feed line and the ground plane.

4. The antenna device of claim 3, further comprising a power divider structure connecting the conductive feed line and the second conductive feed line to a third conductive feed line.

5. The antenna device of claim 1, wherein the conductive patch antenna element comprises a slotted circular metal member.

6. The antenna device of claim 1, wherein the conductive feed line has a first width along a direction parallel to a surface of the ground plane, wherein opposing walls of the cavity are separated by a second width in the direction parallel to the surface of the ground plane, and wherein the second width is greater than the first width.

7. The antenna device of claim 1, further comprising gas disposed within the cavity.

8. The antenna device of claim 7, wherein the gas is air.

9. The antenna device of claim 1, wherein the one or more first dielectric layers includes a first dielectric layer having a first layer side and a second layer side opposite the first layer side, wherein the conductive feed line has a first line side and a second line side opposite to the first line side, wherein the conductive patch antenna element is coupled to the first dielectric layer via the first layer side, wherein the first line side is coupled to the first dielectric layer via the second layer side, and wherein the ground plane and the second line side are formed on opposite sides of the cavity.

10. The antenna device of claim 9, wherein the first dielectric layer is coupled to the conductive feed line via a second dielectric layer of the one or more first dielectric layers.

11. The antenna device of claim 1, wherein materials of the conductive patch antenna element, the conductive feed line, the one or more first dielectric layers, the ground plane, and the spacer structure are pliable to conform to a curved surface.

12. A method of forming an antenna device, the method comprising:

forming a conductive patch antenna element on a first dielectric layer;

forming a conductive feed line on the first dielectric layer or on a second dielectric layer;

forming one or more walls defining a cavity in a third dielectric layer; and forming a stack such that a first spacer structure separates the conductive patch antenna element and the conductive feed line and a second spacer structure separates the conductive feed line and the ground plane, wherein the first spacer structure includes the first dielectric layer, the second dielectric layer, or both, wherein the second spacer structure includes the third dielectric layer, and wherein the ground plane is separated from the conductive patch antenna element by the conductive feed line.

13. The method of claim 12, wherein the conductive patch antenna element is formed by subtractively patterning a conductive material on the first dielectric layer to define a slotted circular member.

14. The method of claim 12, wherein the conductive patch antenna element is formed by adding a conductive material to a surface of the first dielectric layer to define a slotted circular member.

15. The method of claim 12, wherein the conductive feed line is formed by subtractively patterning a conductive material on the second dielectric layer to define a plurality of traces interconnected by one or more power divider structures.

16. The method of claim 12, wherein the conductive feed line is formed by adding a conductive material to a surface of the second dielectric layer to define a plurality of traces interconnected by one or more power divider structures.

17. The method of claim 12, wherein forming the stack includes:

aligning structures of two or more dielectric layers; and adhering the two or more dielectric layers to one another.

18. The method of claim 12, further comprising attaching the ground plane or a coating underlying the ground plane to a contoured surface of a structure.

19. The method of claim 18, wherein the structure is a portion of an aircraft.

20. A system comprising:

a structure defining a surface;

communication equipment at least partially within the structure; and an antenna device physically coupled to the surface of the structure and electrically coupled to the communication equipment, the antenna device comprising:

a conductive patch antenna element disposed on a surface of a circuit board;

a conductive feed line embedded within the circuit board;

a ground plane; and a spacer structure separating the conductive feed line and the ground plane, the spacer structure defining one or more walls of a cavity between the conductive feed line and the ground plane and including one or more dielectric layers, wherein the ground plane is separated from the conductive patch antenna element by the conductive feed line.

21. The system of claim 20, wherein the structure comprises an aircraft, a spacecraft, a watercraft, or a land vehicle.

* * * * *